US005970537A

United States Patent [19]

Hanes et al.

[11] Patent Number: 5,970,537

[45] Date of Patent: Oct. 26, 1999

[54] FOLDING BED FRAME STRUCTURE AND METHOD OF FABRICATING SAME

[75] Inventors: Fred E. Hanes, Muldrow, Okla.; Allen M. Williams, Van Buren; Michael L. Cope, Fort Smith, both of Ark.

[73] Assignee: Hickory Springs Manufacturing Co., Hickory, N.C.

[21] Appl. No.: 09/017,848

[22] Filed: Feb. 3, 1998

[51] Int. Cl.[6] ..... A47C 17/04; A47C 19/00; A47C 19/12

[52] U.S. Cl. ..... 5/13; 5/201; 5/286; 5/12.1

[58] Field of Search ..... 5/13, 12.1, 51.1, 5/201, 282.1, 285, 286, 620; 29/91.1

[56] References Cited

U.S. PATENT DOCUMENTS

| | | | |
|---|---|---|---|
| 1,832,729 | 11/1931 | Ohnstrand . | |
| 2,631,305 | 3/1953 | Hooker | 5/286 |
| 4,536,904 | 8/1985 | Whitehead | 5/201 |
| 5,528,777 | 6/1996 | Arft | 5/13 |
| 5,644,804 | 7/1997 | Wang | 5/12.1 |

FOREIGN PATENT DOCUMENTS

| | | | |
|---|---|---|---|
| 2584907 | 1/1987 | France | 5/201 |

*Primary Examiner*—Alexander Grosz
*Attorney, Agent, or Firm*—Kennedy Covington Lobdell & Hickman LLP

[57] ABSTRACT

A folding bed frame structure comprises spaced apart folding side frame assemblies connected with transversely extending cross members by a combination of mating frictionally interfitting "swaged" and tongue-and-slot connections which do not require or utilize fasteners, thereby permitting the structure to be shipped and stored in disassembled condition. Side frame elements of the bed frame structure have an angled base portion with an arcuate portion extending therefrom to simulate the appearance of tubular elements.

10 Claims, 6 Drawing Sheets

48
52
50
18

50
52
48
30
18'
18

50
52
48
C
30
18'
C
18

FOLDING BED FRAME STRUCTURE AND METHOD OF FABRICATING SAME

BACKGROUND OF THE INVENTION

The present invention relates generally to folding bed frames structures and, more particularly, to a novel folding bed frame structure and fabrication method having frictionally inter-fitting components assemblable without fasteners.

Folding bed frame structures of various configurations and constructions are well known and in widespread use, particularly in so-called sofa sleepers which basically comprise an upholstered sofa frame in which a folding bed frame structure is mounted for selective articulated movement between a folded condition fully contained within the sofa frame for seating use as a sofa and an unfolded condition extending outwardly from the sofa frame for sleeping use as a bed.

Conventionally folding bed frame structures used in sofa sleepers basically comprise a pair of laterally spaced side frame assemblies each formed of multiple pivoted or hinged frame components connected by various cross members for coordinated folding and unfolding movement between retracted and extended positions. Under traditional manufacturing techniques, the various cross members are rigidly affixed permanently to the two side frame assemblies by rivets or like fasteners typically installed by hydraulic or pneumatic riveting guns.

While this matter of construction and assembly of sofa sleeper bed frame structures has proven reliable in practice and the resultant folding bed frame structures had been demonstrated over time and usage to be of a stable and secure assembly, this matter of construction nevertheless presents several disadvantages. First, the use of rivets to assemble the various components makes the assembly operation relatively time consuming and labor intensive. The special riveting tools thusly required add to the capital outlay required of the manufacturer, and such tools pose an additional risk of potential injury to assembly workers. The fully assembled structure occupies a relatively large volume in relation to its total weight, which prevents efficient compact shipping, further adding to the total cost to the end user. Finally, the relative permanency of the riveted connections utilized makes it difficult and costly to replace defective or damaged components.

Conventional sofa sleeper bed frame structures characteristically utilize so-called "angle" members having an L-shaped cross-section for the side frame components, which provides advantages in the manufacturing process in that shorter rivets may be utilized to join to the "angle" components with lesser force required of the riveting tool while at the same time achieving a stronger rivet joint as compared to the alternative of utilizing tubular side frame components. However, many furniture manufacturers prefer the appearance of tubular components over "angle" components despite the structural advantages of the latter.

SUMMARY OF THE INVENTION

It is accordingly an object of the present invention to provide a folding bed frame structure particularly adapted for use in a sofa sleeper or the like, which addresses and overcomes the above-described disadvantages of conventional sofa sleeper constructions. A more specific object of the present invention is to provide a folding bed frame structure whose side frame assemblies and cross members may be connected with one another without the use of rivets or other fasteners and without requiring any special equipment or tools for assembly. A particular objective in eliminating the use of rivets is to provide the capability of shipping and storing the components of a folding bed frame structure in disassembled form so that the volumetric capacity of truck trailers and other shipping containers can be optimized. A further aspect of the present invention is to provide a novel cross-sectional configuration for the side frame elements in folding bed frame structures, which provides the strength and assembly advantages of conventional "angle" members yet simulates the appearance of tubular components for aesthetic purposes.

Briefly summarized, these and other objectives of the present invention are achieved by a folding bed frame structure suitable for use in a sofa sleeper, which basically comprises a pair of folding side frame assemblies spaced apart in opposed facing relation to one another, with each side frame assembly having plural side frame elements pivotally connected to one another, and a plurality cross members extending transversely between the side frame assemblies for coordinated pivoting movement of their respective side frame elements between a retracted condition with the side frame elements relatively folded and an extended condition with the side frame elements relatively aligned. Essentially, in accordance with the present invention, each of the side frame assemblies and the cross members are connected with one another by respective mating portions which interfit frictionally.

The respective mating portions connecting the side frame assemblies and the cross members may be of many various particular configurations and manners of assembly, but it is contemplated that each connection will typically comprise a receiving opening formed in either the side frame assembly or the cross member and a correspondingly shaped extension on the other thereof to be frictionally inserted into the receiving opening. For example, the side frame assembly or the cross member may be fabricated with a tubular receiving end interiorly defining a receiving opening, with the other component having an extending end portion shaped in mating correspondence to the interior receiving opening, i.e., for telescopic-like insertion to produce a so-called "swaged" connection joint. Another contemplated form of connection comprises an elongate slot formed through either the side frame assembly or the cross member with the other having a projecting tongue shaped cross-sectionally in mating correspondence to the slot to be inserted therethrough. In a preferred embodiment of the bed frame structure of the present invention, the side frame assemblies are connected with some of the cross members by the telescopic-like "swaged" form of connection and by a tongue-and-slot form of connection with other cross members.

In accordance with another aspect of the present invention, the inventive structure of the folding bed frame structure described above provides a novel method by which such structure may be fabricated. Basically, the use of non-riveted connections enables the side frame assemblies and the cross members to be shipped and/or stored in disassembled condition for later assembly by the manufacturer or customer.

Another feature of the present invention resides in configuring one or more of the side frame elements of the side frame assemblies to have a base portion having an angled cross-section to facilitate connection with other components of the folding bed frame structure and an arcuate portion extending from the base portion for providing an appearance to each side frame element simulative of a tubular element.

DESCRIPTION OF THE PREFERRED EMBODIMENTS

Figure 1:
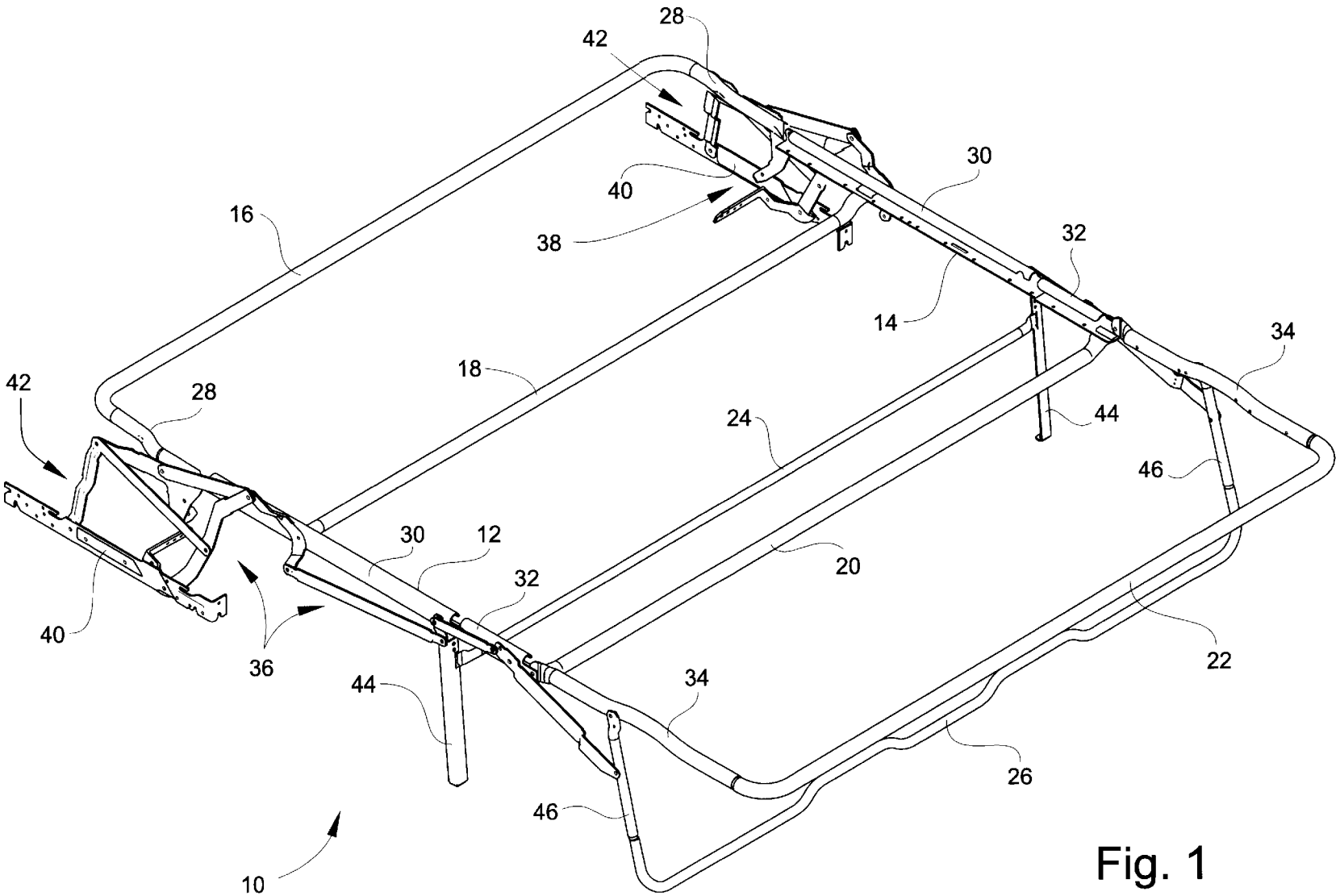
FIG. 1 is a perspective view of a folding bed frame structure for use in a sofa sleeper in accordance with a preferred embodiment of the present invention, wherein the various components of the structure are shown in fully assembled form.
Figure 2:
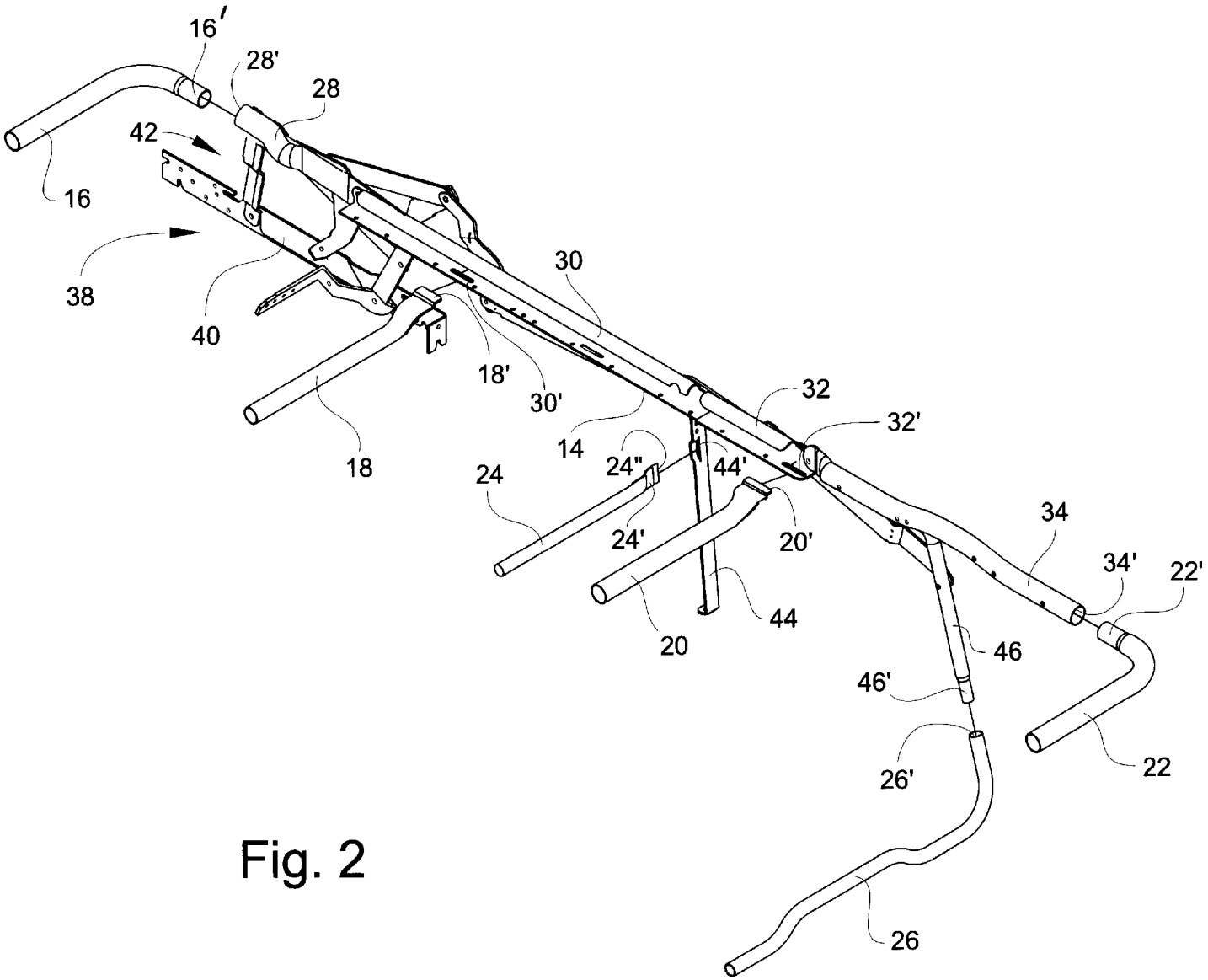
FIG. 2 is another perspective view similar to FIG. 1, showing the right side frame assembly and the various cross members in exploded disassembled form.

Referring now to the accompanying drawings and initially to FIGS. 1 and 2, a folding sofa sleeper bed frame structure in accordance with a preferred embodiment of the present invention is indicated generally at 10 in a fully assembled condition in FIG. 1 and in an exploded condition in FIG. 2. Basically, the sofa bed frame structure 10 comprises a pair of mirror-image folding side frame assemblies 12, 14, designated herein respectively as the "left" and "right" side frame assemblies (as viewed in FIGS. 1 and 2), connected in spaced-apart opposed facing relation to one another by a plurality of cross member 16, 18, 20, 22, 24, 26 (described more fully hereinafter) extending transversely between the left and right side frame assemblies 12, 14, for coordinated folding movement of the side frame assemblies 12, 14 between a retracted condition (not shown) and the fully extended condition depicted in FIGS. 1 and 2.

Each of the folding side frame assemblies 12, 14 basically comprises a rear end side frame element 28, a main side frame element 30, an intermediate side frame element 32, and a forward end side frame element 34, pivotally connected end-to-end in series with one another for relative folding and unfolding movement under the constraint and control of a respective pair of left and right side linkage assemblies, generally indicated respectively at 36 and 38.

The linkage assemblies 36, 38 may be of essentially any appropriate mechanical arrangement and configuration suitable for articulating the respective side frame elements, 28, 30, 32, 34 between the aforesaid retracted (folded) and extended (unfolded) conditions, the particular linkage assemblies 36, 38 in FIGS. 1 and 2 being shown merely by way of illustration and not by way of limitation. Various other conventional forms of such linkage assemblies may also be utilized. Since linkage assemblies of such type are conventional and basically well known, a detailed description of the particular linkage assemblies 36, 38 is not believed to be necessary to an enabling disclosure and understanding of the present invention.

The left and right side linkage assemblies 36, 38 are of identical mirror-image construction, each comprising a main mounting bracket 40 to be rigidly affixed interiorly within an upholstered sofa frame (not shown), typically to the left and right end arm rest structures thereof. Each linkage assembly comprises an interconnected series of mechanical links and lever arms (not individually described or identified, but representatively indicated by way of example at 42) connected between the main mounting bracket 40 and the individual side frame elements 28, 30, 32, 34 of the respective left and right side frame assemblies 12, 14, for constraining the side frame elements to pivotally fold and unfold relative to one another in a defined sequence of motions between the aforesaid retracted condition, wherein the side frame elements 28, 30, 32, 34 are relatively folded with respect to one another into the confines of the sofa frame, and the aforesaid extended condition, wherein the side frame elements 28, 30,32, 34 project forwardly and outwardly beyond the sofa frame in relative alignment with respect to one another to form a horizontal sleeping surface. Each of the side frame assemblies 12, 14 includes a main support leg 44 pivotally connected at the joint between the main and intermediate side frame elements 30, 32 and a forward support leg 46 pivotally connected to the forward end side frame element 34. Appropriate links or levers of the linkage assemblies 36, 38 are connected to the support legs 44, 46 to actuate unfolding movement thereof downwardly into a supporting disposition in the extended condition of the bed frame structure and folding movement into nested positions in the retracted condition thereof.

Figure 3A:
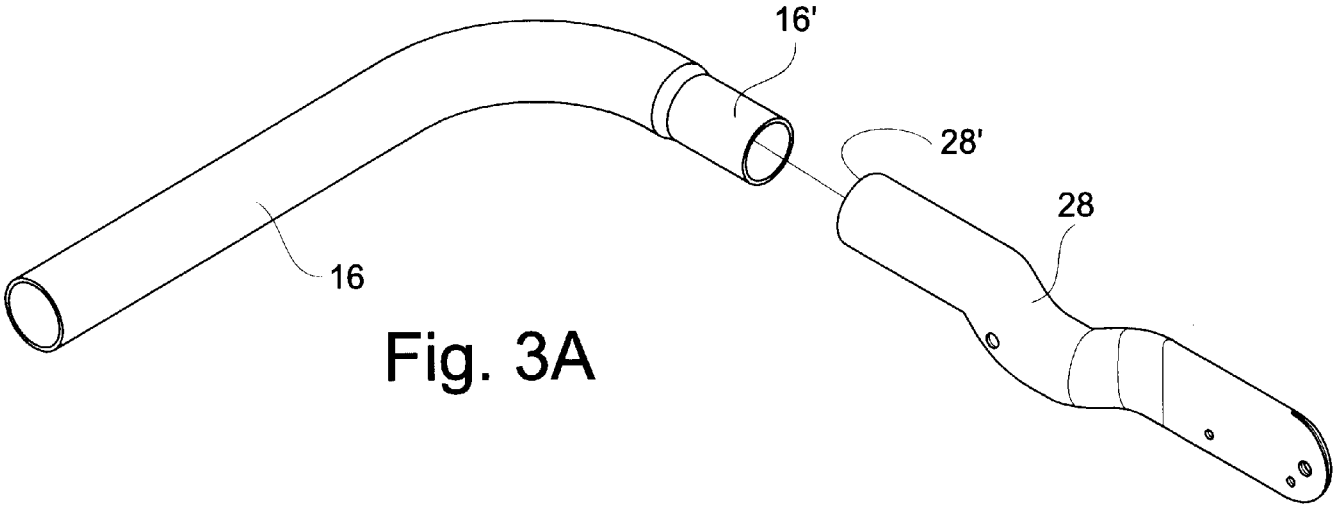
FIGS. 3A and 3B are perspective views showing the rear end side frame element of the right side frame assembly and the mating rear end cross member of the folding bed frame structure of FIGS. 1 and 2 in exploded disassembled and assembled conditions, respectively.
Figure 3B:
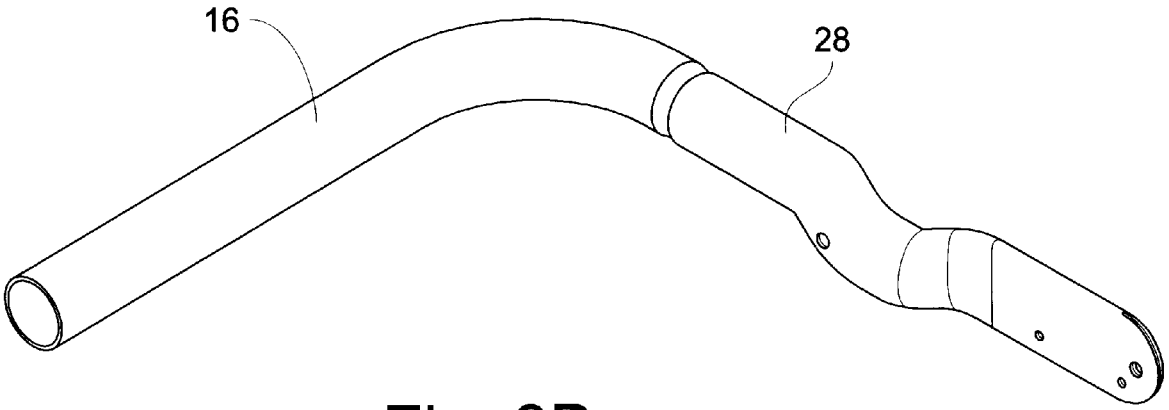
Figures 4A, 4B, 4C:
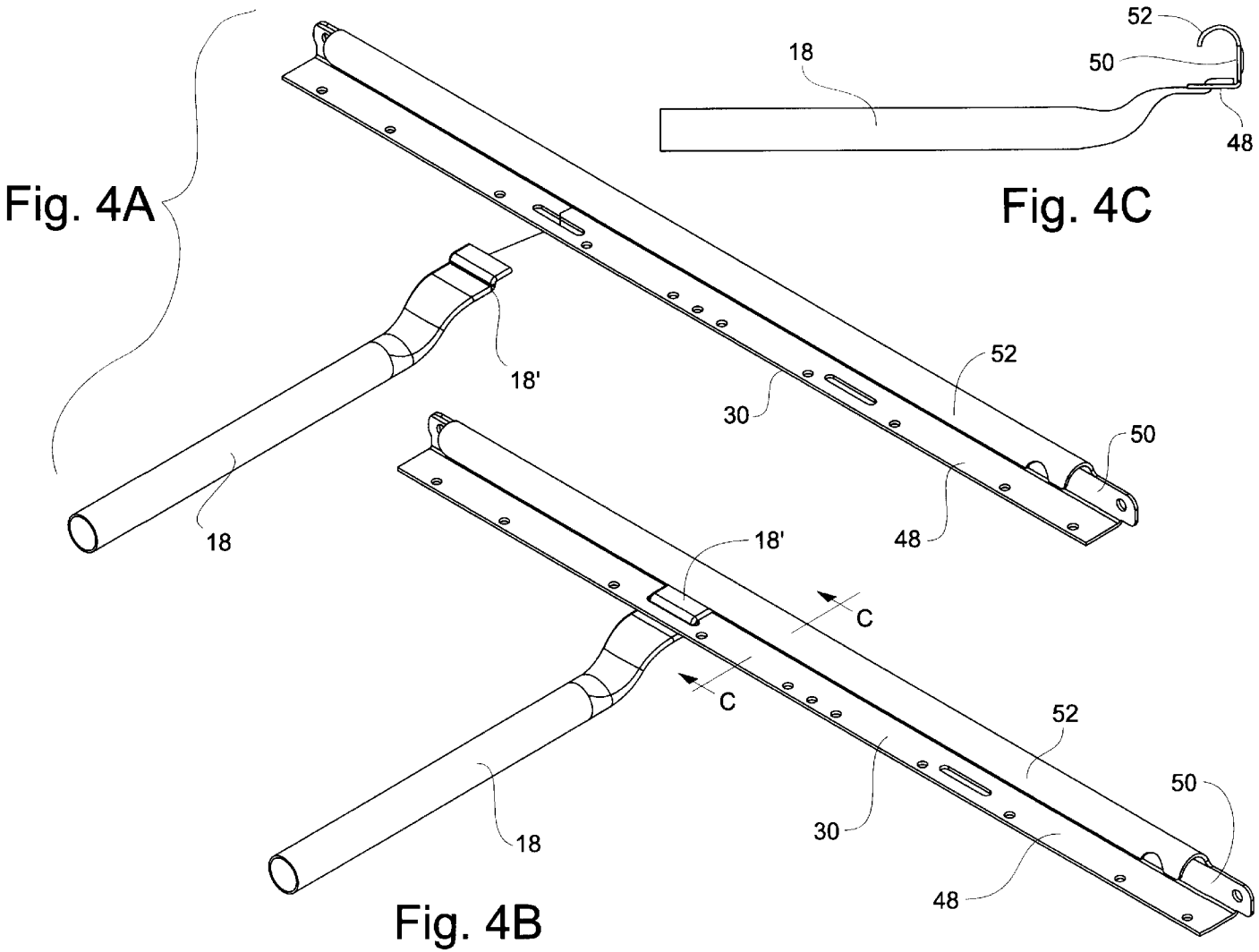
FIGS. 4A and 4B are perspective views showing the main side frame element of the right side assembly and the mating main cross member of the folding bed frame structure of FIGS. 1 and 2 in exploded disassembled and assembled conditions, respectively.
FIG. 4C is a vertical cross-sectional view taken through the main side frame element of FIG. 4B along line c—c thereof, showing the assembly of the main side frame element and the main cross member.
Figure 5B:
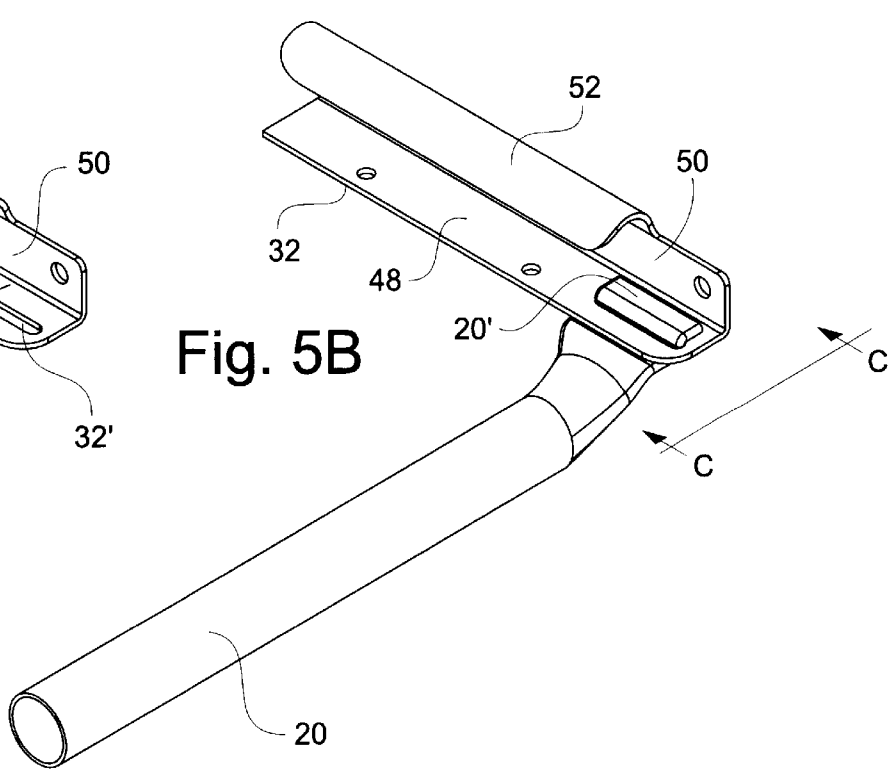
FIGS. 5A and 5B are perspective views showing the intermediate side frame element of the right side frame assembly and the mating intermediate cross member of the folding bed frame structure of FIGS. 1 and 2 in exploded disassembled and assembled conditions respectively.
Figure 5A:
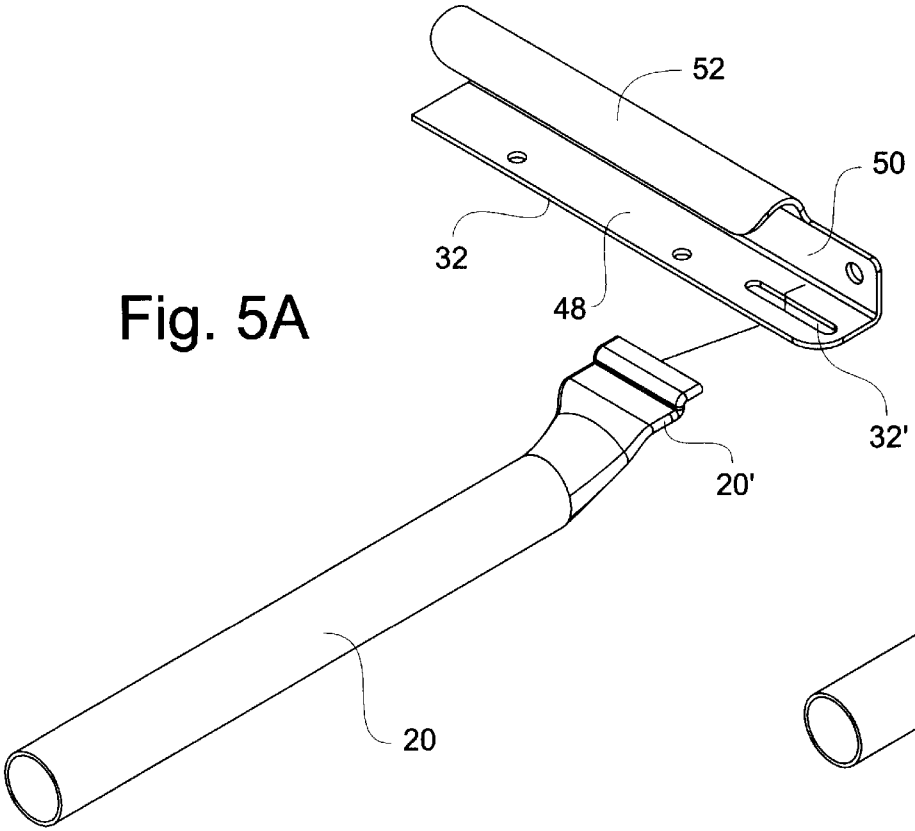
Figure 5C:
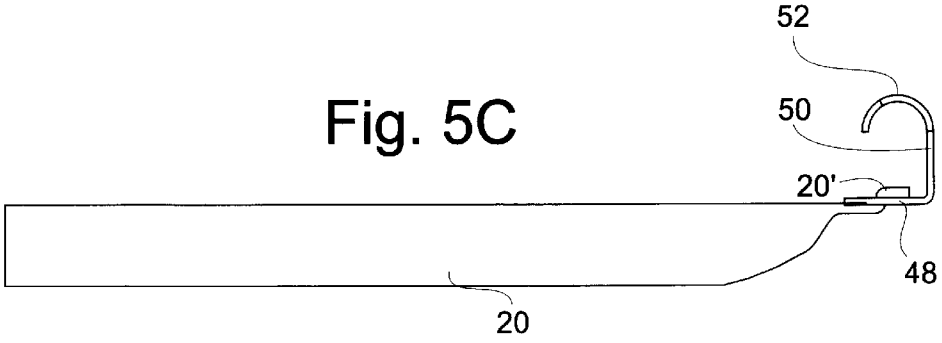
FIG. 5C is a vertical cross-sectional view taken through the intermediate side frame element of FIG. 5B along line c—c thereof, showing the assembly of the intermediate side frame element and the intermediate cross member.

As depicted overall in FIG. 2 and as illustrated in greater detail in the remaining figures of the drawings, a fundamental feature of the present invention resides in the connection of the several cross members 16, 18, 20, 22, 24, 26 between the left and right side frame assemblies 12, 14 by the frictional interfitting of mating portions thereof without the use of rivets or other fasteners. In the preferred embodiment of the bed frame structure 10 illustrated in the drawings, the rear end frame element 28 of each of the left and right side frame assemblies 12, 14 is of a tubular hollow configuration at the rearwardly projecting free end thereof, thereby defining interiorly a receiving opening 28' for the associated rear end cross member 16. The opposite ends of the rear end cross member 16, in turn, are compatibly formed of an essentially identical cross-sectional size and shape, preferably in the form of a "swaged" end portion 16', adapted to be securely press-fitted frictionally into the hollow free-ends 28' of the respective rear end frame elements 28, as best seen in FIGS. 3A and 3B.

In similar manner, the forwardly projecting free end 34' of each of the forward end side frame elements 34 of the left and right site frame assemblies 12, 14 are of a hollow tubular configuration defining an interior receiving opening and the opposite ends 22' of the forward end cross member are compatible configured as "swaged" ends of substantially the identical size and shape to be securely fitted frictionally into the respective hollow free end 34' of the forward end frame elements 34, as best shown in FIG. 2. The respective free ends 46' of the forward support legs 46 of each side frame assembly 12, 14 are similarly of a "swaged" configuration to be frictionally received in compatibly configured hollow tubular end openings 26' in the opposite ends of the forward leg cross member 26, as also shown in FIG. 2.

As best shown in FIGS. 4A–4C and FIGS. 5A–5C, the main and intermediate side frame elements 30, 32 of each of the left and right side frame assemblies 12, 14 are not of the same tubular construction as the rear and forward end frame elements 28, 34. Rather, the main and intermediate frame elements 30, 32 are formed as so-called "angle" members having an L-shaped cross section (FIGS. 4C and 5C) formed by a horizontal leg 48 projecting inwardly with respect to the bed frame structure 10 and an outward leg 50 projecting vertically upwardly from the outward edge of the horizontal leg 48. Such an angled configuration to the frame elements 30, 32 optimizes the strength and stability of the pivotal connections of such frame elements 30, 32. On the other hand, to simulate a tubular configuration compatibly similar to that of the rear and forward end frame elements 38, 34 to enhance the aesthetics of the bed frame structure 10, each of the main and intermediate frame elements 30, 32 includes an arcuate portion 52 extending upwardly and inwardly from the respective vertical leg 50 thereof (FIGS. 4C and 5C), which additionally provides the structural advantage of improving the overall strength of each frame element 30, 32.

By virtue of the angled configuration of the main and intermediate frame elements 30, 32, in the absence of any free end thereof, a "swaged" form of connection with their respective cross members 18, 20 is not possible. Rather, as best seen in FIGS. 4A, 4B and 5A, 5B, each of the main and intermediate frame elements 30, 32 is formed with an elongated slot 30, 32, respectively, and each associated cross member 18, 20 is formed at each end thereof with a flattened tongue 18, 20, respectively, bent into succeeding 90° angles to fit securely through the respective frame element slots 30, 32 with the respective tongues 18, 20 in mated abutment with the top and bottom surfaces of the associated frame elements 28, 30 (See FIGS. 4C and 5C).

Figure 6B:
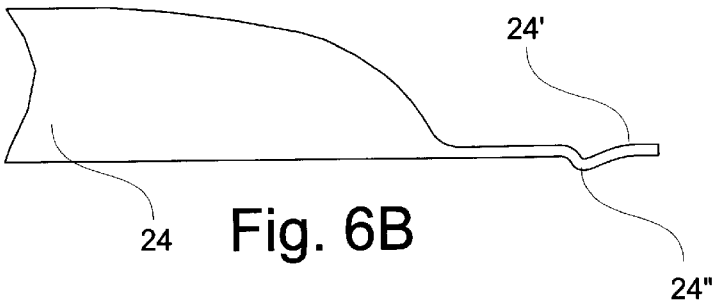
FIG. 6B is a relatively enlarged plan view of the end tongue of the leg cross member of FIG. 6A.
Figure 6A:
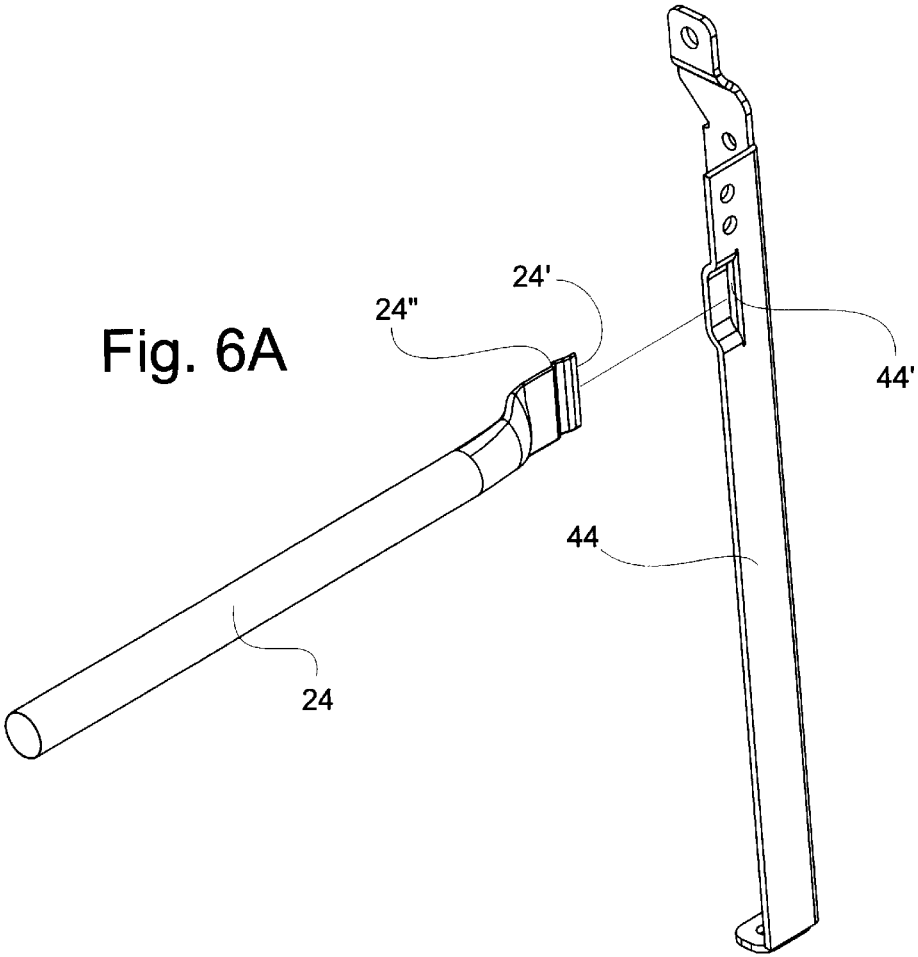
FIG. 6A is an exploded perspective view showing the support leg for the main side frame element of the right side frame assembly and the mating leg cross member of the folding bed frame structure of FIGS. 1 and 2 in exploded disassembled condition.

Similarly, as best shown in FIGS. 6A and 6B, each of the main support legs 44 of the left and right side frame assemblies 12, 14, are of an "angled" configuration, with the inwardly projecting leg thereof formed with a rearwardly deflected portion to define a slot 44'. The opposite ends of the main leg cross member 24' are formed with flattened tongues 24, bent angularly at an intermediate location 44' to form a detent adapted to fit securely into the slot 44 of the associated support leg 44 in a snap type manner.

As will thus be understood, the folding sofa bed frame structure of the present invention provides the fundamental advantage of requiring no rivets nor any special tools or equipment such as hydraulic or pneumatic riveting guns, to assemble the respective side frame assemblies and cross members. In turn, the assembly of the bed frame structure does not require skilled labor and yet may nevertheless be accomplished more quickly and easily than by a riveting form of assembly and without the hazard and risk of injury associated with the use of riveting guns. Replacement of defective or damaged components is also simplified. Furthermore, the respective components of the bed frame structure may be shipped and stored in a disassembled condition, enabling the manufacturer to minimize shipping costs by efficiently maximizing the shipping weight of the bed frame structures per unit volume available within shipping containers. In addition, the provision of an arcuate portion to the angled main and intermediate side frame elements enables all of the strength and assembly advantages of such angled components to be realized, while aesthetically simulating the appearance of tubular side frame elements.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

We claim:

1. A folding bed frame structure for use in a sofa sleeper and the like, comprising a pair of folding side frame assemblies spaced apart in opposed facing relation to one another, each side frame assembly having a plurality of side frame elements pivotably connected to one another, and a plurality of cross members extending transversely between the side frame assemblies for coordinated pivoting movement of their respective side frame elements between a retracted condition wherein the side frame elements are relatively folded with respect to one another and an extended condition wherein the side frame elements are relatively aligned with respect to one another, each of the side frame assemblies and the cross members being connected with one another by respective mating portions which interfit frictionally.

2. A folding bed frame structure according to claim 1, wherein the respective mating portions connecting one side frame assembly and one cross member comprise a receiving opening formed in one thereof and a correspondingly shaped extension on the other thereof frictionally inserted into the receiving opening.

3. A folding bed frame structure according to claim 2, wherein the respective mating portions connecting one side frame assembly and one cross member comprise a tubular receiving end on one thereof interiorly defining the receiving opening and an extending end portion on the other thereof shaped in mating correspondence to the interior receiving opening forming the extension.

4. A folding bed frame structure according to claim 2, wherein the respective mating portions connecting one side frame assembly and one cross member comprise an elongate slot formed through one thereof defining the receiving opening and a projecting tongue on the other thereof shaped cross-sectionally in mating correspondence to the slot forming the extension.

5. A folding bed frame structure according to claim 1, wherein at least one of the side frame elements comprises a base portion having an angled cross-section for connection with other components of the folding bed frame structure and an arcuate portion extending from the base portion for providing an appearance to the side frame element simulative of a tubular element.

6. A method of fabricating a folding bed frame structure for use in a sofa sleeper and the like, comprising providing a pair of folding side frame assemblies each having a plurality of side frame elements pivotably connected to one another, providing a plurality of cross members for connecting the side frame elements, forming each of the side frame assemblies and the cross members with respective mating portions for frictional interfitting connection without fasteners, and assembling the folding side frame assemblies and the cross members without utilizing fasteners by arranging the side frame assemblies in spaced apart opposed facing relation to one another and connecting the cross members transversely between the side frame assemblies by frictionally interfitting their respective mating portions, whereby the respective side frame elements are connected for coordinated pivoting movement between a retracted condition wherein the side frame elements are relatively folded with respect to one another and an extended condition wherein the side frame elements are relatively aligned with respect to ones another.

7. A method of fabricating a folding bed frame structure according to claim 6, and further comprising shipping the folding side frame assemblies and the cross members in a disassembled condition.

8. A method of fabricating a folding bed frame structure according to claim 6, and further comprising storing the folding side frame assemblies and the cross members in a disassembled condition.

9. A folding bed frame structure for use in a sofa sleeper and the like, comprising a pair of folding side frame assemblies spaced apart in opposed facing relation to one another, each side frame assembly having a plurality of side frame elements pivotably connected to one another, and a plurality of cross members extending transversely between the side frame assemblies for coordinated pivoting movement of their respective side frame elements between a retracted condition wherein the side frame elements are relatively folded with respect to one another and an extended condition wherein the side frame elements are relatively aligned with respect to one another, at least one of the side frame elements comprising a base portion having an angled cross-section for connection with other components of the folding bed frame structure and an arcuate portion extending from the base portion for providing an appearance to the side frame element simulative of a tubular element.

10. A folding bed frame structure according to claim 9, wherein each of the side frame elements comprises a said base portion and a said arcuate portion.

* * * * *